United States Patent [19]

Hamacher

[11] 4,186,432

[45] Jan. 29, 1980

[54] LAMP FOR USE IN SUBTERRANEAN APPLICATIONS

[76] Inventor: Martin Hamacher, Küferstr. 5, Waltrop, Fed. Rep. of Germany, 4355

[21] Appl. No.: 853,804

[22] Filed: Nov. 21, 1977

[30] Foreign Application Priority Data

Nov. 20, 1976 [DE] Fed. Rep. of Germany ..... 7636602

[51] Int. Cl.[2] ..... H01J 5/52; H01J 5/60; H01J 5/54; H01J 61/50; H01J 61/56; F21V 19/04; F21V 23/04; F21V 25/12

[52] U.S. Cl. ..... 362/226; 313/49; 313/51; 339/111; 362/158; 362/164; 362/189; 362/216; 362/223; 362/263; 362/267; 362/362; 362/374; 362/375

[58] Field of Search ..... 362/158, 164, 165, 216, 362/263-265, 267, 375, 374, 84, 183, 189, 223, 362, 226; 313/49, 51; 339/111

[56] References Cited

U.S. PATENT DOCUMENTS

| | | | |
|---|---|---|---|
| 755,307 | 3/1904 | Moore | 362/84 |
| 2,265,475 | 12/1941 | Fodor | 362/164 |
| 2,640,145 | 5/1953 | Martt | 362/226 |
| 2,791,679 | 5/1957 | Hierholzer, Jr. et al. | 362/226 |
| 3,124,307 | 3/1964 | Hoskins et al. | 362/226 |
| 3,382,413 | 5/1968 | Gandhi et al. | 313/51 |
| 3,504,339 | 3/1970 | Dailey | 362/263 |
| 3,748,458 | 7/1973 | Morrison et al. | 362/267 |

FOREIGN PATENT DOCUMENTS

| | | | |
|---|---|---|---|
| 896946 | 5/1962 | United Kingdom | 362/260 |
| 269304 | 7/1970 | U.S.S.R. | 362/263 |

*Primary Examiner*—Benjamin R. Padgett
*Assistant Examiner*—T. S. Gron
*Attorney, Agent, or Firm*—Karl F. Ross

[57] ABSTRACT

A lamp for use in subterranean galleries such as mines in which the cold-cathode discharge tube is received in a housing which, in turn, is removably mounted in a receptacle and is held in place by a ring clamping a flange of the housing against a flange of the receptacle. The housing may be provided with a translucent cover so that the housing can be removed and replaced as a unit. A reed switch on the receptacle cooperates with a magnet on the housing to deenergize the terminals of the housing upon its removal. The terminals of the discharge tube are embedded in an insulating potting mass within the housing.

8 Claims, 5 Drawing Figures

LAMP FOR USE IN SUBTERRANEAN APPLICATIONS

FIELD OF THE INVENTION

The present invention relates to a lamp and, more particularly, to a cold-cathode or discharge tube lamp which may be used where there is a danger of explosion or the like. More particularly, the invention relates to a lamp of the cold-cathode or discharge-tube type for use in subterranean applications, e.g. mine shafts and galleries.

Cold-cathode or discharge-tube lamps generally comprise a light-emitting tube which is energized from the secondary side of a transformer received in a housing to which the glow tube or lamp can be removably connected, the housing forming a junction box to which the electrical conductors are introduced usually by sealed conduit or the like.

Lamps of this type have found application in subterranean uses, e.g. to illuminate the galleries or shafts of a mine.

When it is desired to replace the discharge tube, it is generally necessary to remove a cover, thereby affording access to the interior of the housing in which the glow tube is replaceably received. The discharge tube is thereupon extracted and a new cold-cathode lamp is inserted. The cover serves to protect the surfaces of the discharge tube from contamination by dirt and dust particles. During the lamp-replacement operation, however, dirt and dust invariably find their way into contact with the interior of the housing and the discharge tube, even when the latter is freshly disposed within the housing.

In addition, the replacement of the cold-cathode lamp or discharge tube in a lamp assembly of the type described has been found to be problematical in other ways.

In addition, it is frequently desirable to provide such assemblies so that the terminals to which the discharge tube is connected are de-energized for removal of the discharge tube from the assembly. In this case, a switch may be provided between the power-supply conductors and the transformer primary or between the secondary side of the transformer and the lamp terminals. Conventional constructions of this type have also created difficulties when it was desired to automatically de-energize the connection terminals of the lamp within the housing for removal of the discharge tube therefrom.

OBJECTS OF THE INVENTION

It is the principle of the present invention to provide an improved lamp assembly using a cold-cathode or discharge tube light-emitting source, hereinafter referred to generally as the lamp, whereby the aforementioned disadvantages are obviated and replacement of the lamp in the assembly is facilitated.

Another object of the invention is to provide a simplified lamp assembly of low cost affording convenient and rapid replacement of the light-emitting means without contamination of the assembly or the light-emitting surfaces.

It is another object of the invention to provide a lamp assembly having means for automatically de-energizing the contacts or terminals for connection to a cold-cathode tube or discharge tube which affords greater safety and reliability as well as lower construction and maintenance costs.

SUMMARY OF THE INVENTION

These objects and others which will become apparent hereinafter are attained, in accordance with the present invention, in a lamp assembly which comprises a lamp housing forming a unit with the light-emitting lamp, i.e. a cold--cathode or discharge tube, which is receivable removably as a unit in a receptacle with respect to which the housing can be fitted in a dust-tight manner. The cover of this housing forms part of the replaceable unit and can be separable from the housing but forms a dust-tight enclosure for the light-emitting tubes therewith.

Thus, for the replacement of the lamp tube in a lamp assembly of the present invention, the complete dust-tight unit with the housing, cover and tube, is removed and replaced within the receptacle.

The unit itself is not opened at the site of replacement, i.e. within the mine shaft or gallery, but can be opened at a dust-free location remote therefrom for removal of the lamp tube and its replacement in the unit if such is desired. Thus, the lamp tube remains free from contamination within the unit even when it is replaced and the unit is thereby renewed for use in the replacement of a defective lamp unit at a later date.

According to a feature of the invention, the lamp housing in which the discharge tube or cold-cathode tube is received, is formed with an outwardly extending annular flange which can rest upon a flange or rim of the receptacle permanently mounted in the mine gallery or shaft and held in place by a frame which fits over and around the cover of the unit and clamps the flange thereof against the rim of the receptacle. The frame can be held in place by removable or disengageable screws.

To replace the unit in this case, it is merely necessary to unscrew the frame, withdraw the unit from the receptacle and insert another unit and thereupon replace the frame.

According to a feature of the invention, the cold-cathode tube or discharge tube has its terminal ends embedded in a sealing mass forming the base of the housing, this sealing mass being an electrically insulating potting compound in which the electrical terminals of the lamp are embedded.

The cover for the lamp tube or tubes can be secured to the housing by connecting profiles of U-section and composed of an elastic material. In this case, the profiles can clamp an outer flange of the cover against the outer flange of the housing which also serves to attach the replaceable unit to the receptacle in the manner previously described. Naturally, when the cover is unitarily formed with the elastic U-profile members, they can simply snap over an outwardly extending flange of the housing. Usually, however, the profiles are not integral with either the housing or the cover so that they can be simply removed by spreading apart at arms of the U and enable the cover to be separated from the housing to afford access to the lamps within the housing.

According to yet another feature of the invention, a contactless switch is provided within the lamp housing and the removal of the cover, the unit or the lamp displaces an actuator for the contactless switch, i.e. a switch which does not require physical contact with the removable unit, to de-energize the terminals of the connector feeding the lamp. The switch may be a reed switch and the actuator a permanent magnet. According to the invention, the switch is closed only when the unit, the housing, the cover and/or the lamp tube are properly set into the receptacle. As soon as the receptacle is opened, the contactless switch is interrupted and de-energizes the electrical contacts within the housing. The replacement of the lamp can thus proceed in the usual manner without any danger of sparking.

The lamp assembly of the present invention permits the lamp tube to be replaced in a particular simple, clean and convenient manner as contrasted with the prior art. In earlier systems, the lamp tube could only be replaced upon removal of a cover from the housing and this, naturally, permitted contamination of the new lamp and the interior of the housing in which the new lamp was received. With the system of the invention, however, the lamp tube remains sealed within its replaceable unit and the unit can be opened at a clean location where there is no danger of contamination.

The receptacle of the assembly is, in addition, provided with the contactless or reed switch which is connected in circuit between the terminals connectable with the unit and the secondary side of the transformer or between the primary side of the transformer and the current-supply line. The unit is formed at its bottom with a switch actuator, e.g. the permanent magnet mentioned previously, so that upon removal of the unit the circuit to the contacts which will be exposed upon the removal of the unit is interrupted. Only when a new unit is introduced into the receptacle is the circuit again closed to these terminals.

Preferably, the receptacle is provided with an outwardly extending circumferential flange surrounding the opening in which the base or housing of the unit is received, this flange sealingly engaging a flange of the unit. The frame can overlie the flange of the unit and be attached by screws to the flange of the receptacle and can clamp the U-profile member which, in turn, holds the cover to the housing of the unit.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
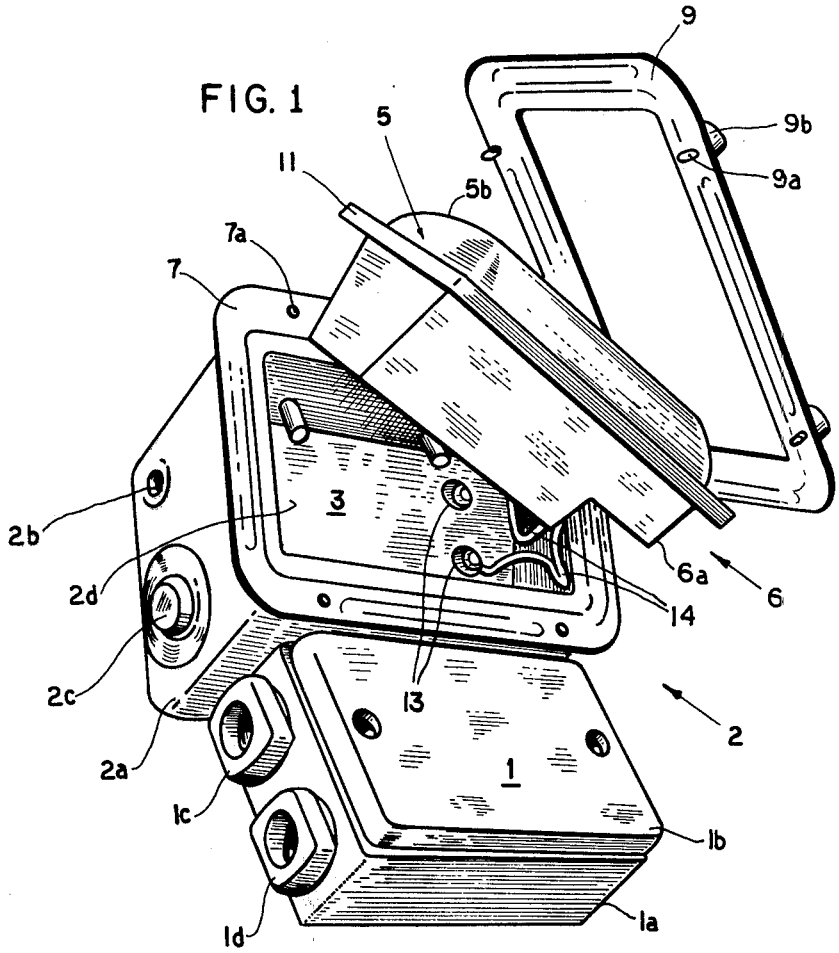
FIG. 1 is a partially exploded perspective view of a lamp assembly according to the invention.

The assembly illustrated in FIG. 1 comprises a junction box 1 formed with a lower portion 1*a* and a cover 1*b* attached by screws to the lower box member 1*a* which is provided with fittings 1*c* and 1*d* for connecting conduits to the lamp assembly. The electrical conductors for energizing the lamp assembly extend through the conduit in the usual manner.

The junction box 1, is affixed to a receptacle 2, which may also be a diecast metal box 2*a* formed with a peripheral flange surrounding a socket-forming opening 3. The box 2*a* may also be provided with knockouts 2*b* for the connection of additional conduits to the system and, if desired, with a switch 2*c* which can be manually actuated to de-energize the lamp. Below the terminal plate 2*d* of the socket 3, there can be provided a transformer, not shown, whose secondary side energizes the lamp unit 6 in accordance with the principles of cold-cathode or discharge-tube illumination operations.

Figure 3:
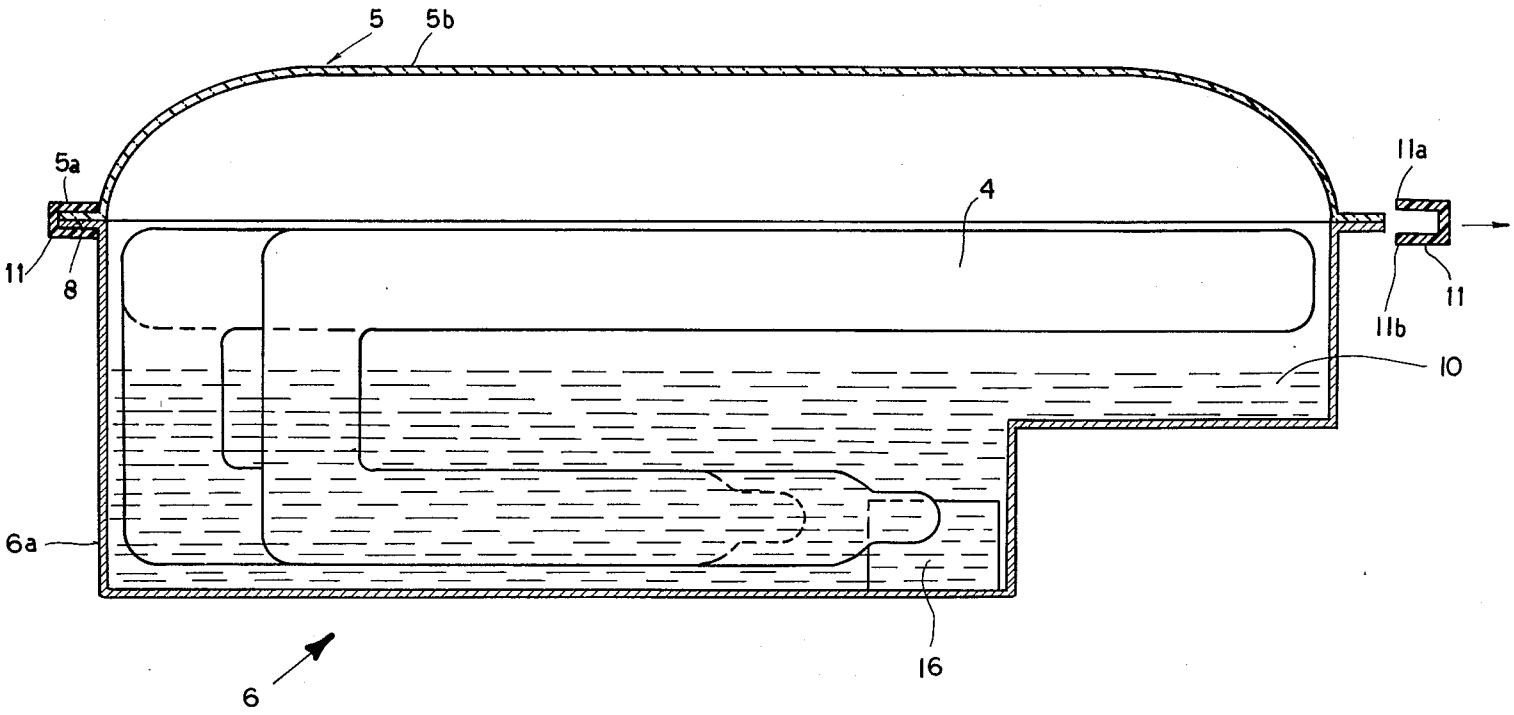
FIG. 3 is a cross-sectional view taken along the line III—III of FIG. 2 but with the cover in place.

The unit 6 which is received in the socket 3 comprises a housing 6*a*, a cover 5, a discharge tube or cold-cathode lamp 4 within this housing, and a U-section profile member 11 which can be opened to release the cover 5 from the housing 6*a* (see FIG. 3). The cover 5 seals the housing 6 in a dust-free manner and is translucent.

Figure 2:
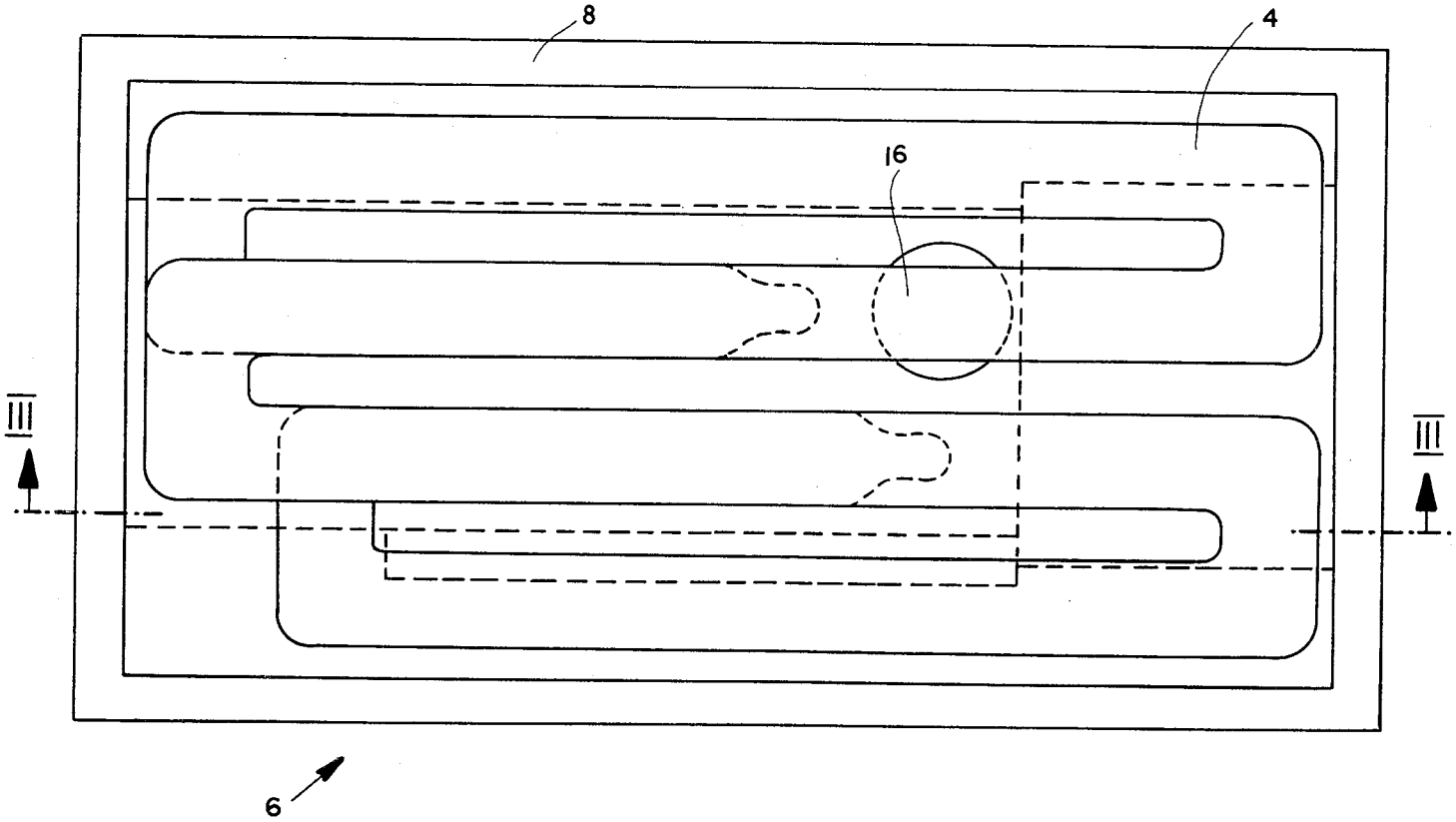
FIG. 2 is a plan view of the lamp housing of the replaceable unit of FIG. 1, drawn to an enlarged scale and with the translucent cover removed.

As can be seen from FIGS. 1–3, the unit 6 is replaceably received in the space 3 of the receptacle 2 and carries the lamp tube 4 within the unit. However, since the cover 5 is removable from the housing 6*a* but is connected in a dust-right manner therewith, the lamp tube 4 can be replaced within the housing 6 at a location remote from the remainder of the assembly 2 etc. without permitting contamination of the lamp tube. The flange 7 can be overlain by a peripheral flange 8 of the housing 6. The cover 5 has a flange 5*a* adapted to overlie the flange 6 so that the arms 11*a* and 11*b* of the profile 11 can grip the flanges 5*a* and 8 between them and, in addition, serve as a seal between the unit 6 and the flange 8.

A frame 9 is adapted to overlie the flanges 5*a* and 8 and to clamp the latter against the flange 7. To this end, screws 9*a* with milled heads 9*b* are provided on the frame 8 which extends around the domed portion 5*b* of the cover 5.

Within the housing 6, as can be seen in FIG. 3, the terminal ends of the lamp tube r are embedded in a cast base 10.

When the lamp tube 4 must be replaced, the screws 9*a* are released from the threaded bores 7*a* in the flange 7 and the frame 9 is removed. The unit 6, complete with the light tube 4, is drawn and replaced by another similar unit. At a location outside the mine shaft or gallery, the profile 11 is removed to permit the cover 5 to be lifted from the housing 6 and permit the lamp tube 4 to be replaced. The unit 6 is then reassembled and can be employed when replacement of another unit is required.

The profile 11 serves to provide a dust-tight seal of the unit 6 and also as a seal between this unit and the receptacle 2.

The junction box 1 can be provided with the usual terminals which are connected by conductors to the receptacle 2 especially through a transformer 12 whose secondary winding is connected to the light tube 4.

The receptacle 2 is formed with elastic terminals 13 which are connectable via conductors 14 to the terminals of the tube 4.

Figure 4:
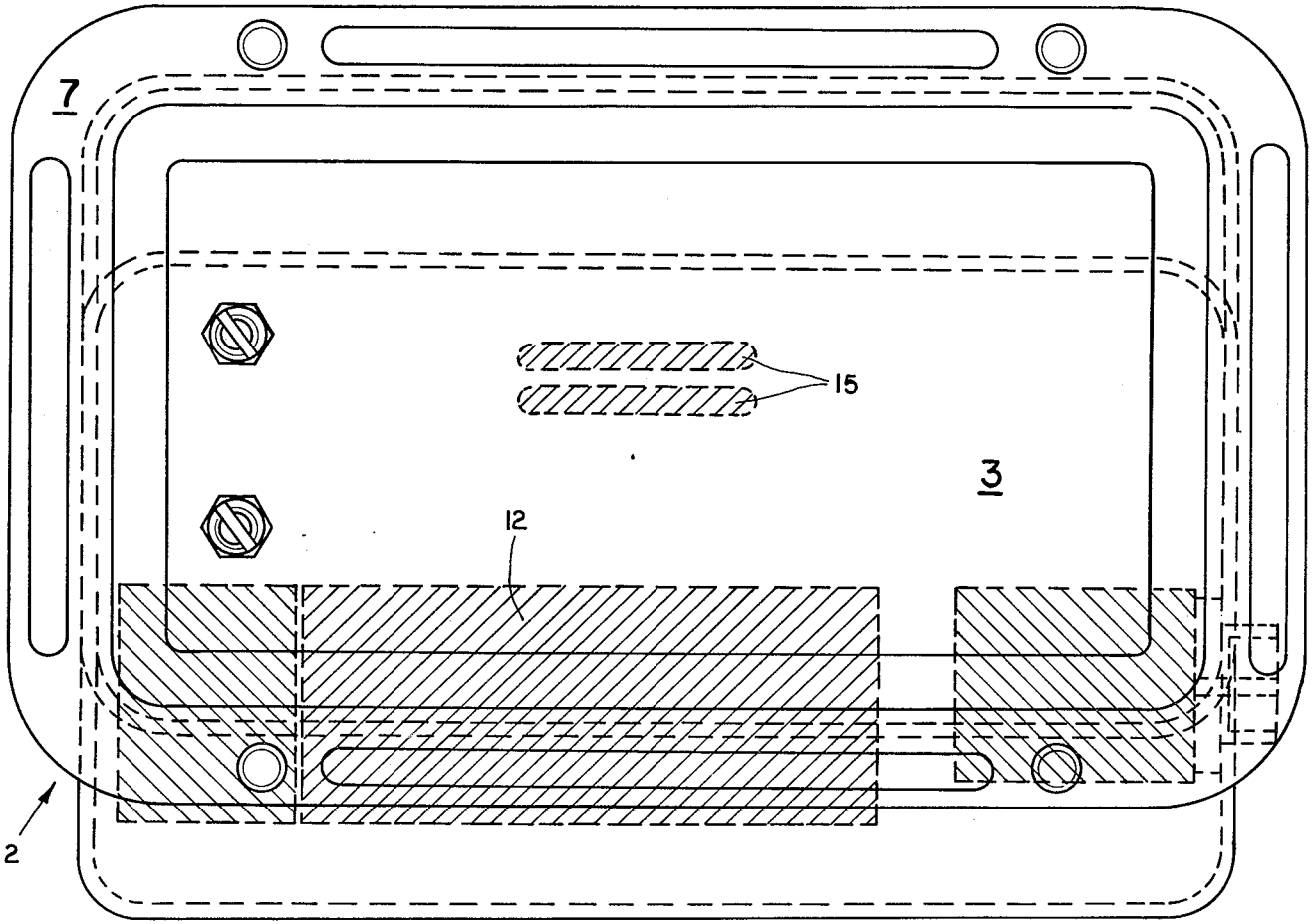
FIG. 4 is a view enlarged with respect to FIG. 1 but showing the receptacle of the present invention and its relationship to the reed switch.

For safety reasons, the circuit within the housing 2 and especially the terminals 13 should be automatically de-energized when the assembly is subject to replacement of the lamp unit. As can be seen from FIGS. 2–4, this is achieved by providing a contactless electric switch 15 in the receptacle 2 in the circuit to the terminals 13. The switch 15 is a reed switch which is operated by a permanent magnet 16 disposed within the unit 6. Thus, as the unit 6 is withdrawn from the receptacle, the normal open reed switch no longer is affected by the magnetic field and open circuits to de-energize the terminals 13. However, upon replacement of the unit 6 by another such unit, the magnet 16 acts upon the reed switch to close the circuit to terminals 13.

Figure 5:
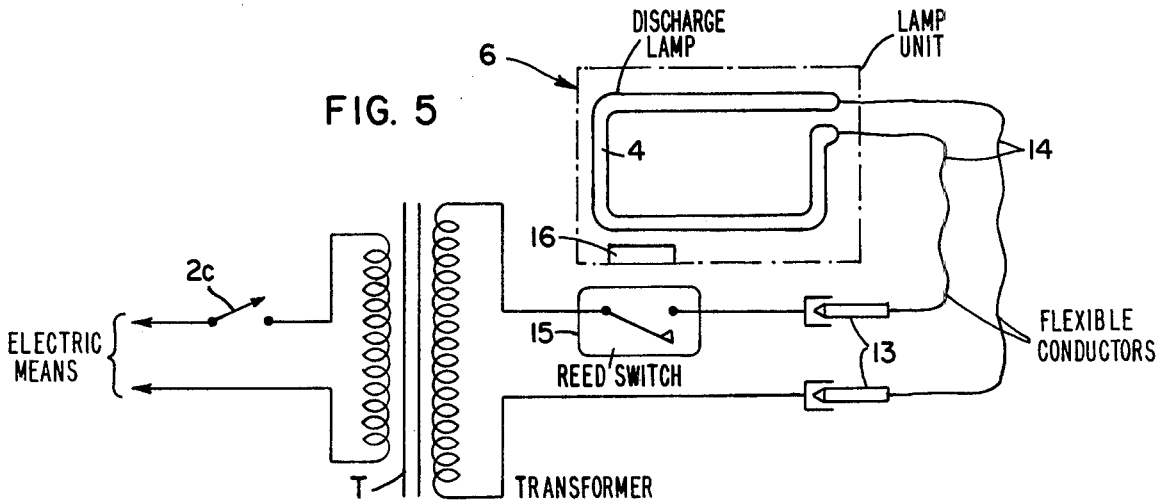
FIG. 5 is a circuit diagram for the lamp.

FIG. 5 shows that the primary of the transformer T is connected through the switch 2*c* to the electrical mains while the secondary of the transformer is connected through the reed switch 15 to the terminals 13 which is connected by the flexible conductors 14 to the lamp 4 of the unit 6. The magnet 16 normally closes the reed switch when the lamp unit is in place but, upon displacement of the lamp unit out of the receptacle, before the terminals 13 are disconnected, the switch 15 opens to de-energize the lamp and these terminals. The latter can thus be disconnected for safe removal of the lamp.

I claim:

1. A cold-cathode lamp assembly comprising:

a receptacle open at one side;

a lamp unit removably receivable in said receptacle and electrically connected therewith, said unit including:

a housing open at one side, a cold-cathode discharge tube replaceably received in said housing, a cover for closing said side of said housing, and means for sealing said cover to said housing to render said unit dust-free;

means for securing said unit in said receptacle;

a pair of terminals on said receptacle connectable with said unit; and contactless switch means for de-energizing said terminals upon removal of said unit from said receptacle, said unit having an actuator for open-circuiting said contactless switch means without contact therewith upon displacement of said unit away from said contactless switch means.

2. The assembly defined in claim 1 wherein said receptacle is formed with a peripheral flange and said unit has an outwardly extending flange resting upon said flange of said receptacle, said means for securing said unit in said receptacle including a frame extending around said cover and clamping said flange of said unit against said flange of said receptacle.

3. The assembly defined in claim 2 wherein said unit is provided at the side of said housing opposite the open side thereof with a cast base at least partially surrounding ends of said tube.

4. The assembly defined in claim 3 wherein said cover is affixed to said housing by a U-section profile member engaging outwardly extending flanges on said cover and said housing.

5. The assembly defined in claim 1 wherein said switch means includes a reed switch in said receptacle and said actuator is a magnet on said unit cooperating with said reed switch.

6. The assembly defined in claim 5 wherein said receptacle has an outwardly extending peripheral flange and said cover and said housing are each provided with outwardly extending peripheral flanges connected together by a U-profile member resting upon said flange of said receptacle, said cover having a dome surrounded by a frame connected to said flange of said receptacle and clamping said member and said cover against said flange of said receptacle.

7. A cold-cathode lamp assembly comprising:

a receptacle open at one side and provided opposite said side with a pair of terminals;

a unit comprising a dust-free housing and a cold-cathode tube enclosed in said housing, said unit being receivable in said receptacle and connectable to said terminals; and switch means operable upon removal of said unit to de-energize said terminal, said switch means including a reed switch received in said receptacle and said unit being provided with a permanent magnet operating said reed switch.

8. The assembly defined in claim 7, further comprising a transformer in said receptacle connected to said terminals.

* * * * *